United States Patent [19]

Kessler

[11] Patent Number: 5,022,646

[45] Date of Patent: Jun. 11, 1991

[54] FLUID FILLED JUMPING STICK

[75] Inventor: Brian D. Kessler, Youngstown, Ohio

[73] Assignee: Maui Toys, Inc., Youngstown, Ohio

[21] Appl. No.: 443,405

[22] Filed: Nov. 30, 1989

[51] Int. Cl.[5] ..... A63B 5/20

[52] U.S. Cl. ..... 272/75

[58] Field of Search ..... 272/74, 75, 143; 446/267

[56] References Cited

U.S. PATENT DOCUMENTS

| | | | |
|---|---|---|---|
| 104,674 | 6/1870 | Whitehead | 272/74 |
| 169,625 | 11/1875 | Crandall | 272/74 |
| 1,436,703 | 11/1922 | Fisher | 272/75 |
| 2,223,174 | 11/1940 | Hughes | 272/75 |
| 2,253,075 | 8/1941 | Johnson | 272/75 |
| 2,738,616 | 3/1956 | Windle | 446/267 |
| 3,061,307 | 10/1962 | Burr . | |
| 3,064,972 | 11/1962 | Feinn | 272/75 |
| 3,107,916 | 10/1963 | Cooper | 272/74 |
| 3,118,666 | 1/1964 | Fitch . | |
| 3,363,898 | 1/1968 | Crovello | 272/75 |
| 3,466,032 | 9/1969 | Thornton | 272/74 |
| 3,481,600 | 12/1969 | Lang et al. | 272/74 |
| 3,517,931 | 6/1970 | Kalish . | |
| 3,633,925 | 1/1972 | Deese . | |
| 3,958,802 | 5/1976 | Thornton | 272/74 |
| 4,082,266 | 4/1978 | Elkins . | |
| 4,094,502 | 6/1978 | Cook . | |
| 4,124,206 | 11/1978 | Price | 272/74 |
| 4,136,866 | 1/1979 | Bouvier | 272/75 |
| 4,157,827 | 6/1979 | Winston et al. | 272/143 |
| 4,158,457 | 6/1979 | Hydro . | |
| 4,192,501 | 3/1980 | Peoples | 272/75 |
| 4,315,623 | 2/1982 | Granderson . | |
| 4,375,886 | 3/1983 | Muys . | |
| 4,489,934 | 12/1984 | Miller | 272/75 |
| 4,496,146 | 1/1985 | Jackemeyer . | |
| 4,529,193 | 7/1985 | Kuhnsman | 272/75 |
| 4,536,002 | 1/1986 | Jardine . | |
| 4,618,142 | 10/1986 | Josehph, Jr. | 272/75 |
| 4,733,861 | 3/1988 | Plunkett, III | 272/75 |
| 4,776,585 | 10/1988 | Maleyko et al. | 272/75 |
| 4,919,417 | 4/1990 | Poulas | 272/75 |

FOREIGN PATENT DOCUMENTS

| | | | |
|---|---|---|---|
| 0816571 | 7/1969 | Canada | 272/74 |

*Primary Examiner*—Richard J. Apley
*Assistant Examiner*—L. Thomas
*Attorney, Agent, or Firm*—Browdy and Neimark

[57] ABSTRACT

A flexible tubular jumping rope or section of a jumping hoop is shown partly filled with a fluid and particles which reflect or refract light floating in the fluid. The fluid in combination with the transparent tubing forms an attractive and novel jumping device.

A rigid center section is also provided of a light transmitting plastic which contains a fluid and light refracting or reflecting particles. The center section creates an attractive appearance and adds interest to the device.

Different embodiments of bearings or rotary connections between end caps or handles and the flexible loop center section or jump rope are also disclosed.

A sleeve surrounding a rigid center section, which permits rotation between the sleeve and the center rigid section is shown. The sleeve is gripped by the user's hand and the center rod rotates within the sleeve as the jumping hoop rotates around the user.

18 Claims, 2 Drawing Sheets

10
35
38
35

10
36
35
17
35

33
32
15

30
16
17
15
31
42
43
41
40

43
47
46'

43
44
40
45
46

FLUID FILLED JUMPING STICK

BACKGROUND OF THE INVENTION

1. Field of the Invention

This invention is in the field of toys and exercise devices known generally as jump ropes or jump sticks. In one embodiment these devices include a flexible rope which is held in the user's hands separately. In another embodiment there is a rigid center section or pole to which the ends of the rope are mounted, and the device is operated by manipulating the rigid center section.

2. Prior Art

Use of jump ropes and jump ropes having rigid center sections are well known in the art as illustrated by U.S. Pat. Nos. 3,958,802 (Horton), 4,082,226 (Elkins), 4,192,501 (Peoples), 4,315,623 (Granderson), 4,618,142 (Joseph), 4,496,146 (Jackemeyer), 3,633,925 (Deese), 3,064,972 (Feinn), 3,061,307 (Burr), 104,674 (Whitehead), 169,625 (Crandall) 3,466,032 (Thornton), 3,118,666 (Fitch), 4,733,861 (Plunkett), and 4,094,502 (Cook).

Also known in the art are jumping rope devices wherein water flows through the center of a tube to propel the tube or jump rope device. Patents describing this type of arrangement are U.S. Pat. Nos. 3,107,916 (Cooper), 3,481,600 (Lang et al), and 4,124,206 (Price).

The art also includes different means for attaching jump ropes or jump loops to handles. These patents include U.S. Pat. Nos. 3,517,931 (Kalish), 4,136,866 (Bouvier), 4,375,886 (Muys), 4,563,002 (Jardine), 4,489,934 (Miller), 4,529,193 (Kuhnsmann), 259,440 (Turnbull) and 4,776,585 (Maleyko et al).

Maleyko et al '585 shows the use of washer like bearings mounted within a handle. Turnbull U.S. Pat. No. 259,440 shows the use of a pair of washers which retain a metallic hoop placed along a center rod.

A product known as "skip stick" manufactured by Worlds of Wonder, Inc., Freemont, Calif. 94538, is a central tube stick having a solid plastic rope attached to caps at the end of the tube stick. The attachment to the caps permits rotary motion of the plastic rope with respect to the hand-held tube stick. The hand-held stick includes grips which fit around the stick and not on the stick end. These handles, however, are a sponge rubber-like material and do not permit rotation between the grip and the jump stick. The plastic rope is held in end caps by means of a metallic loop which is S-shaped through which the plastic rope passes.

U.S. Pat. No. 4,094,502, Cook, shows the use of an exercise device having a rigid frame, and where there is a rotatable handle 15 into which a rod 12 is inserted. There is radial movement between the handle 15 and the rod 12.

U.S. Pat. No. 4,192,501, Peoples, shows an electric jump rope where the rope is connected to a shaft 26 which is rotatable within a tube 24. The tube 24 comprises the jumping handle.

U.S. Pat. No. 259,440, Turnbull, mentioned above, also shows a skipping hoop where the flexible portion A turns with respect to a center portion CBD, and hence teaches the use of a center grip which rotates with respect to a rod L which holds the rope A.

U.S. Pat. No. 3,061,307, Burr shows a motorized jump rope where the rope drive shaft 19 extends within a handle 10 and rotates with respect to the belt 10 and inside a housing 15 fixed to the belt.

U.S. Pat. No. 4,315,623, Granderson, mentioned above, shows a jumping hoop apparatus which includes two spools 20 and 22 which permit rotation of the rod 12 with respect to the hands at spools 20 and 22.

U.S. Pat. No. 4,082,266, Elkins, mentioned above, shows a power jump rope device wherein a handle 13 permits rotation of a shaft 29 within the handle. Therefore, the handle 13 may be held in the hands of the user while the shaft 29 spins with bearings 35.

SUMMARY OF THE INVENTION

In this invention, there is provided a jump rope, or jumping hoop wherein the rope and/or the rigid center section are made of a clear or translucent plastic. Either the flexible section and/or the rigid center section may be filled with a fluid containing light reflecting or light refracting decorative particles. Preferably, the fluid does not entirely fill the hollow spaces so that fluid movement will produce movement of the light refracting or reflecting particles. Both the flexible tube and the rigid center section are constructed so that they are water-tight and fluid can not escape.

In the prior art, there is no example of a fluid contained in a jump device wherein the fluid is sealed inside and can not escape. Still further, there is no example of a hollow translucent or transparent tubing which contains a fluid and refractive and reflective particles used as a jump rope.

It is an object of this invention to provide a refractive jumping device which contains a fluid and light reflectiing/refracting particles. The fluid may be a clear fluid or may be colored. Similarly, the light refracting or reflecting particles may be of any color or of any material which is attractive in appearance when placed inside of the jumping rope tubing.

It is also an object of this invention to provide a grip sleeve around a rigid center rod for the purpose of permitting said rod and sleeve to rotate with respect to each other.

DESCRIPTION OF THE PREFERRED EMBODIMENT

Figure 1:
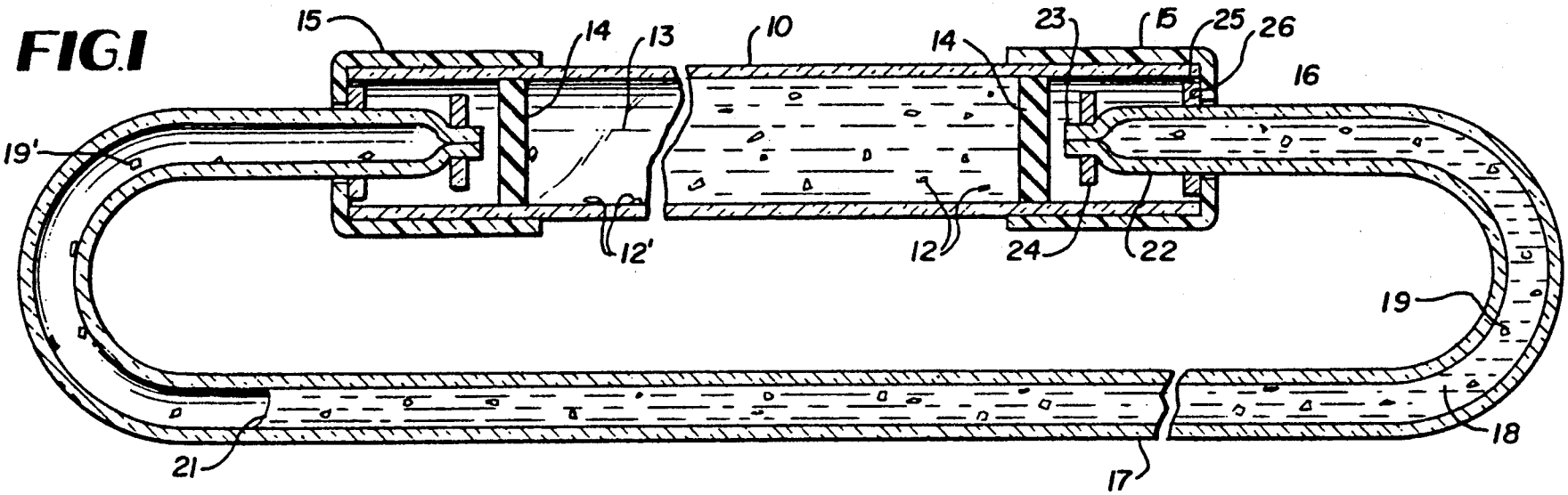
FIG. 1 shows a jumping hoop with a rigid tubular center section and flexible tubular jumping section.

In FIG. 1 there is shown a tubular light transmitting rigid center section 10. The tube 10 may be of any color, and may be either transparent or translucent. Within the tube 10 there is placed a quantity of water 11 or other liquid which preferably does not fill the entire tube section. This quantity of water is allowed to flow back and forth within the tube 10. Also within the water there may be used reflective or refractive particles 12 which distort the light passing through the tube 10 and provides a decorative appearance to the entire assembly. For purposes of illustration, the left hand portion of the tube of FIG. 1 is shown as not including water. This section 13 contains air, and in some cases particles 12' may attach themselves to the empty portion of the tube as the water or fluid 11 moves out of the tubing portion 13. At each end, suitable sealing plugs 14 are placed across the rigid hollow tubular center section to seal in the water and particles and prevent leakage thereof. The seals or plugs 14 may be made of any convenient material such as rubber or plastic, and may be secured to the tube either with a friction fit, or by use of an adhesive. Any water-tight plug will suffice.

Also shown on each end is an end-cap 15. The end-cap 15 fits over the end of the rigid tubular section and has a hole 16 in its end wall. The end-cap may be made of any suitable plastic or other material and may either be fitted to the tube 10 by friction, or some additional adhesive.

Tubing 17 forms the flexible jumping section. The flexible tubing 17 has within it a fluid 18 and particles 19. Fluid 18 may be any suitable transparent fluid, and particles 19 may be any suitable particle which will reflect or refract light. The fluid 18 preferably does not entirely fill the flexible tubing section 17 because the movement of the water back and forth within the tubing provides an attractive appearance and moves the center of gravity of the jumping rope tubing outward. This reduces the effort needed to move the tubing rope overhead. At the left side of FIG. 1, there is shown an area 20 which does not contain a fluid and is therefor filled with air or some other gas. Along the surface of the air-filled tube section 20 are found scattered particles 19' which may stick to the sides of the tube as the water is shifted in the tubing 17. The line formed by the water and air in the tubing 17 is generally depicted at reference numeral 21. In FIG. 1 the tubing end 22 is shown as having a crimped end 23 which may be a crimped section which is also heat sealed. The crimped end 23 is also shown as compressed by a clamp 24. The clamp 24 may be either a plastic or a metallic material which applies pressure to enforce the sealed end of the tube 23. In addition to the sealed end, there is also shown a washer 25. Washer 25 is sufficiently tight against the tubing 17 so that it will not slip off. Washer 25 may also be secured to the tubing by means of an adhesive if necessary. Washer 25 in combination with the inner end wall face 26 forms a bearing surface which permits the tubing end 22 to freely rotate within the end cap 15.

Figure 2:
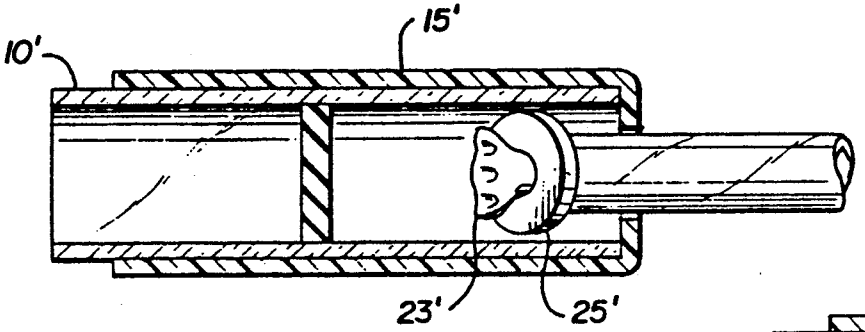
FIG. 2 shows an alternate connection of a jump rope tube to a handle-cap fixed over the end of a rigid tubular center section.

In FIG. 2 there is shown an alternate arrangement where the end cap 15' extends a substantial distance along the tube 10'. In this embodiment, the extension of the end cap 15 creates a suitable handle by which the flexible jumping section may be held in a users hand without the use of the rigid tubular center section 10'. In this configuration, with the rigid center tube 10' removed, the device comprises a jump rope configuration.

Also shown in FIG. 2 is a washer 25'.

FIGS. 3, 4, 5, 6 and 7 show other alternate means for attaching the flexible tubular jumping section to an end cap, or to a handle of a jumping rope.

Figure 3:
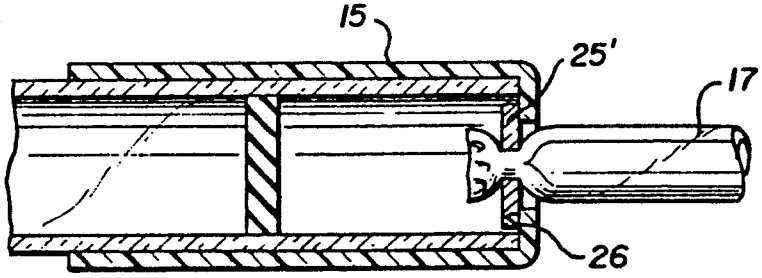
FIG. 3 shows an alternate means for attaching a tube to a handle wherein a washer is placed around the tube and the end is heat sealed and crushed.

In FIG. 3 there is shown the embodiment of FIG. 2 where the washer 25' is pulled up against surface 26 to form an end bearing which will permit rotation of the flexible loop 17 with respect to the cap 15.

Figures 4, 5, 6, 7, 8, 9, 10:
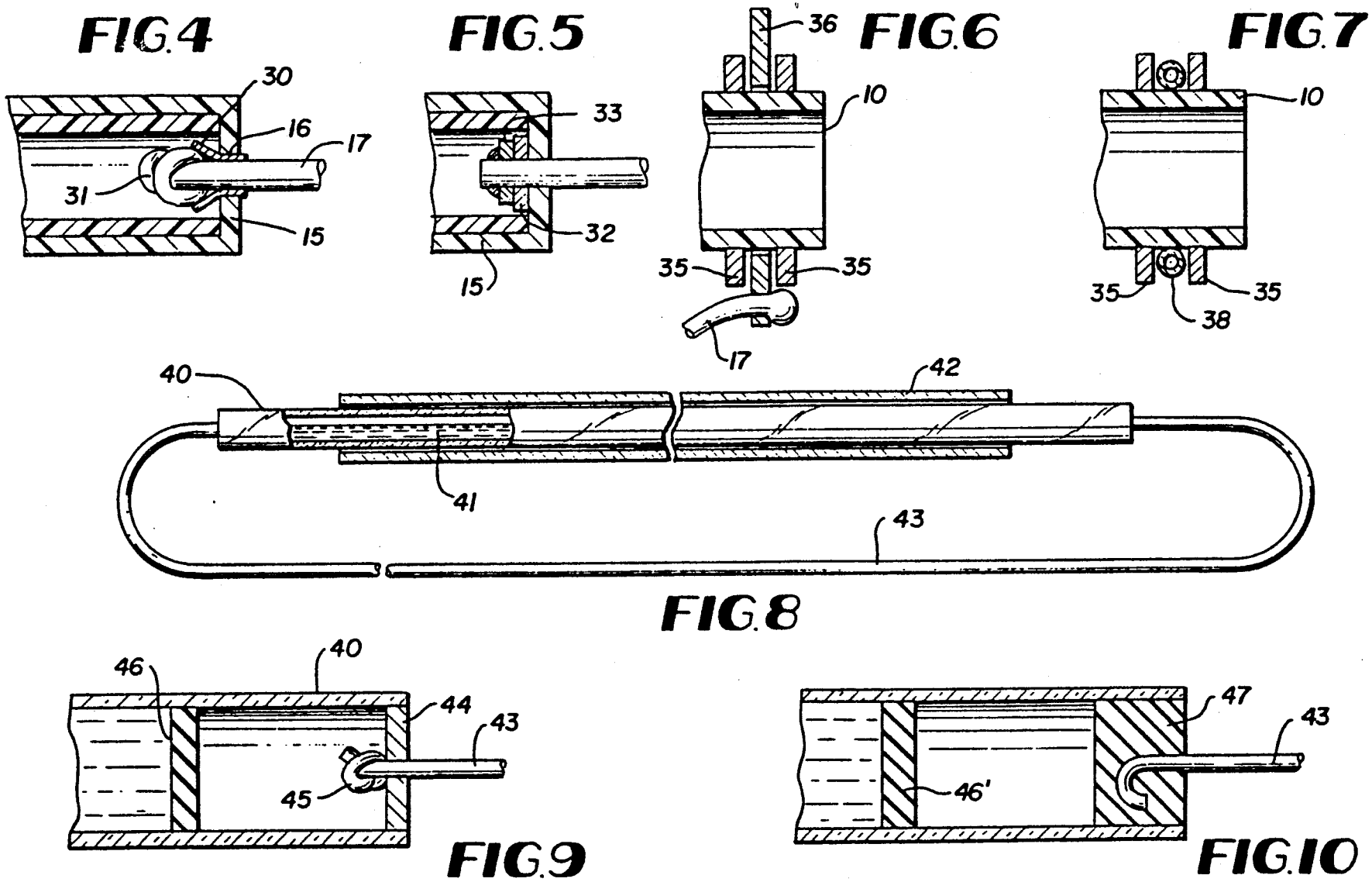
FIG. 4 shows another alternate bearing arrangement for the end of a handle which has conical tapered sides.
FIG. 5 shows an embodiment of a handle connection to a tube wherein two washers are used.
FIG. 6 shows another alternate attachment of a tube to the end of a rigid tubular center wherein washers are used to retain a spinning washer which holds the flexible tube.
FIG. 7 shows an alternate connection to a tube which comprises two washers and a section of rope tied in a loop in between two washers.
FIG. 8 shows another embodiment of this invention which utilizes a sleeve to permit rotation of a rigid center rod.
FIG. 9 shows a means for attaching a flexible jump loop section to a center rod.
FIG. 10 shows another alternate means for fixing a flexible jump loop to a rigid center rod where rotary motion is not permitted.

In FIG. 4 there is shown another embodiment of an end bearing where the retainer/bearing 30 has a conical section and a tubular section. The tubular section fits within the opening 16 of the cap 15 and the conical section prevents its extraction. A bearing surface is formed between the wall of the hole 16 and the tubular-conical retainer/bearing 30. The end of the flexible tubing 17 may be crimped sealed as shown in FIGS. 1, 2 and 3, and may have its end fused together, or a knot tied in it. The purpose of the end knot 31 is to prevent the tubing 17 from sliding through the retainer/bearing 30.

In FIG. 5 there is shown another embodiment of an end cap or handle 15,15' which utilizes two washers to form a bearing surface. A first washer 32 is placed up against the inside surface of the end wall of the cap 15. A second washer 33 is placed around the tube in a tight fit or by an adhesive so that the tube is retained. This embodiment provides smoother action and rotation of the flexible tubing or rope with respect to the handle or rigid tubular section because the material for the first washer 32 may be selected to provide minimum friction between its bearing surface and the surface of the second washer 33. This alternative allows greater flexibility in the selection of the material for the end cap 15 or the removable handle 15'. Hence, the cap 15 may be held on the end of the rigid tube 10 by means of friction, cap 15 may be made of a soft plastic which will squeeze down on the rigid tube 10 and provide a frictional engagement. This type of plastic, however, does not form the best friction-free bearing surface and may require the provision of the first bearing washer 32 as shown in FIG. 5.

In FIG. 6 is shown another embodiment of the rigid tubular section 10 which has a pair of exterior washers 35 fixed near its end. The washers 35 form a groove on the end of the rigid tube section 10. Within this groove is a rotatable ring or washer 36 having an inside diameter slightly greater than that of the tube 10. Washer 36 is therefore free to spin around the tube 10 and within the space defined by the fixed washers 35. A flexible tube 17 or rope may be connected to the washer 36 by any suitable means and may be crimped or sealed by any suitable means.

In FIG. 7 there is shown another embodiment of the rigid tube 10 and fixed washers 35. In this embodiment, the flexible 17 or rope tube is wrapped around the rigid tubular center section as shown by reference numeral 38. The end of the flexible tube 17 or rope forming the circle 38 may be joined by to itself by any suitable clamp or knot, and the end of the flexible tubing 17 may be heat-sealed or otherwise crimped by any suitable mechanical device. In this embodiment, the flexible tubing end 38 is held in position on the end of the rigid tube 10 by means of the washers 35.

In this invention, the fluid 11 in the center section is allowed to slosh back and forth, therefore moving the particles 12 and creating an attractive appearance on the outside. Similarly, fluid 18 containing particles 19 is allowed to flow back and forth in the tube 17, again creating an attractive appearance to the user. The fluid 18 within tube 17 also will be thrown to the center of the tube 17 when the device is in use as a jump rope, or in use as a rigid tubular center section. The fluid, when in the center of the flexible tubing 17, has a greater angular momentum because of the movement of the center of gravity outward away from the tubular center section 10. This provides additional centrifugal force which will enhance the performance of the jumping device.

In FIG. 8 there is shown another embodiment of this invention which comprises a rigid center rod or tube 40 which is hollow and which is partially filled with a fluid 41. The fluid 41 may contain a dye or color, and may also include particles which reflect or refract light. Surrounding the rigid tube 40 is a second grip tube 42. Grip tube 42 is preferably slightly larger in inner diameter than the outside diameter of the tube 40. Tube 42 thus rotates with respect to tube 40. Or stated another way, tube 40 may rotate within tube 42 as the jump loop 43 spins around the user. The user grasps the grip tube 42 which acts as a sleeve around the tube 40. Grip tube 42 does not rotate with respect to the user, while the flexible jump loop 43 and ridgid rod does.

The flexible jump loop 43 also may be partially filled with a fluid having color and/or light reflective or refractive particles suspended therein.

In this embodiment, there is no need to allow the jump rope loop to rotate within the hollow tube 40. Therefore, as shown in FIGS. 9 and 10 as well as FIG. 8 the jump loop is secured to the tube 40 so that rotation does not take place between these two members. In FIG. 9, a washer or other plastic device 44 is shown in the end of a tube 40. The washer 44 may tightly fit tube 43 in order to prevent rotation, or the tube 43 may include a knot 45 which binds up on the surface of the washer 44 to prevent rotation. Also shown in FIG. 9 is a separate seal 46 which is used to retain the fluid within the tube 40 in the event that the end washer 44 is yanked free. Still further, in the embodiment of FIG. 9 a seal 46 is necessary because there is none provided between the jump loop 43 and the rigid center rod 40.

In FIG. 10 there is shown another embodiment wherein an elastomeric material 47 is placed in the end of the rod tube 40. This material has embedded in to it an end of the flexible jump loop 43. In this embodiment, the elastomeric sealant 47 also serves the purpose of retaining the fluid within the rigid center rod 40. If this alternative embodiment is selected, a separate fluid retaining means such as plug or seal 46' is not required.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A convertible jumping stick/jump rope combination, comprising:

a pair of tubular jump-rope handles, each said handle having an open end and a partially closed end, said tubular handles having a pre-selected interior size and shape;

a flexible loop in the nature of a jump rope extending between said substantially closed ends of said handles; and a rigid tubular jumping stick portion having end parts of an exterior size and shape to frictionally interfit in a removable manner within the open ends of said handles.

2. A convertible jumping stick/jump rope combination in accordance with claim 1, wherein said flexible loop comprises a tubular flexible jumping section having a hollow center and formed of transparent or translucent plastic partially filled with liquid containing decorative particles.

3. A jumping stick having a rigid tubular center section and a tubular flexible jumping section, said rigid center section and said flexible loop being connected together end-to-end to form a closed hoop, the improvement comprising:

said tubular flexible jumping section having a hollow center and formed of transparent or translucent plastic, a liquid partially filling said hollow center, and a plurality of decorative particles in said hollow center, wherein said decorative particles are moved by said liquid; and means for rotatably connecting the ends of said tubular flexible jumping section to said rigid tubular center section, said means comprising a cap mounted on each end of said rigid center section, each said cap having a hole in its end for receiving said flexible jumping section, and means for allowing rotation of said flexible jumping section with respect to said rigid center section including retaining means for preventing ends of said tubular flexible jumping section from passing through said holes in said caps, and said ends of said tubular flexible jumping section having a heat compression seal or sonic weld applied thereto.

4. A jumping stick having a rigid tubular center section and a tubular flexible jumping section, said rigid center section and said flexible loop being connected together end-to-end to form a closed hoop, the improvement comprising:

said tubular flexible jumping section having a hollow center and formed of transparent or translucent plastic, a liquid partially filling said hollow center, and a plurality of decorative particles in said hollow center, wherein said decorative particles are moved by said liquid; and wherein said rigid center section is translucent or transparent.

5. The jumping stick of claim 4 wherein said rigid center section has a hollow core which is partially filled with a fluid.

6. The jumping stick of claim 5 wherein said center section has means for sealing said fluid in said hollow core.

7. The jumping stick of claim 5 wherein said fluid contains a plurality of particles which reflect light.

8. The jumping stick of claim 5 wherein said fluid contains a plurality of particles which refract light.

9. The jumping stick of claim 5 wherein said rigid center section is fluid tight and retains fluid placed within it.

10. A jumping stick having a rigid tubular center section and a tubular flexible jumping section, said rigid center section and said flexible loop being connected together end-to-end to form a closed hoop, the improvement comprising:

said tubular flexible jumping section having a hollow center and formed of transparent or translucent plastic, a liquid partially filling said hollow center, and a plurality of decorative particles in said hollow center, wherein said decorative particles are moved by said liquid; and means for rotatably connecting the ends of said tubular flexible jumping section to said rigid tubular center section, said means comprising a cap mounted on each end of said rigid center section, each said cap having a hole in its end for receiving said flexible jumping section, means for allowing rotation of said flexible jumping section with respect to said rigid center section, said caps mounted on the ends of said rigid center section each forming a handle for a jump rope configuration when said caps are removed from said rigid center section.

11. A jumping stick having a rigid tubular center section and a tubular flexible jumping section, said rigid center section and said flexible loop being connected together end-to-end to form a closed hoop, the improvement comprising:

said tubular flexible jumping section having a hollow center and formed of transparent or translucent plastic, a liquid partially filling said hollow center, and a plurality of decorative particles in said hollow center, wherein said decorative particles are moved by said liquid; and means for rotatably connecting the ends of said tubular flexible jumping section to said rigid center section, said means for rotatably connecting the ends of said tubular flexible jumping section to said rigid center section comprising retainer washers mounted on and around said rigid center section, and a rotatable ring mounted between said washers, said rotatable ring having an inner diameter greater than the outside diameter of said rigid center section, and said rotatable ring being connected to said tubular flexible jumping section.

12. A jump rope device having a rigid center rod comprising in combination:

a hollow flexible jumping loop which is fixed to said rod;

a means to prevent rotation of said center rod with respect to said flexible jumping loop, comprising a solid elastomeric material in the ends of the said rigid center rod, said material having the ends of said flexible jumping loop embedded therein;

a grip sleeve means surrounding said rod which permits rotation of said center rod with respect to said sleeve; and a fluid partially filling said hollow flexible jump loop.

13. A jump rope in accordance with claim 12 wherein said rigid center rod is partially filled with a decorative liquid.

14. A jump rope in accordance with claim 13 which further includes means for sealing said liquid in said rod.

15. A jump rope device having a rigid center rod comprising in combination:

a hollow flexible jump loop which is fixed to said rod;

a means to prevent rotation of said center rod with respect to said flexible jump loop, said ends of said hollow flexible jump loop having a sonic weld located between the rigid center rod and the flexible jump loop;

a grip sleeve means surrounding said rod which permits rotation of said center rod with respect to said sleeve; and a liquid partially filling said rigid center rod.

16. In a jump rope having a tubular flexible jumping section having two ends and a handle at each end, the improvement comprising:

said tubular flexible jumping section having a hollow center and formed of transparent or translucent plastic, a liquid partially filling said hollow center, amd a plurality of decorative particles in said hollow center, wherein said decorative particles are moved by said liquid; and means for rotatably connecting the ends of said tubular flexible jumping section to said handles, each said handle having a hole in its end for receiving said flexible jumping section, and means for allowing rotation of said flexible jumping section with respect to said handles including retaining means for preventing ends of said tubular flexible jumping section from passing through said holes in said handles, and said ends of said tubular flexible jumping section having a heat compression seal or sonic weld seal applied thereto.

17. A jump rope according to claim 16 wherein said means for rotatably connecting the ends of said tubular flexible jumping section to said handle further comprises a washer forming a bearing surface about each said end of said tubular flexible jumping section adjacent said seal, said washer lying adjacent and inside said end of said handle.

18. A jump rope according to claim 17 wherein said washer is generally planar and is sealed to said flexible jumping section.

* * * * *